United States Patent [19]

Balling

[11] Patent Number: 4,955,757

[45] Date of Patent: Sep. 11, 1990

[54] HYDRAULIC APPARATUS FOR INSTALLING PIPING BELOW GROUND

[76] Inventor: Curtis Balling, 405 Belmont St., Lakefield, Minn. 56150

[21] Appl. No.: 372,584

[22] Filed: Jun. 29, 1989

[51] Int. Cl.[5] ..... E21B 9/00

[52] U.S. Cl. ..... 405/184; 254/29 R; 173/53

[58] Field of Search ..... 405/154, 184, 230, 232; 254/29 R; 173/53-56; 175/62, 92, 94, 162

[56] References Cited

U.S. PATENT DOCUMENTS

| | | | |
|---|---|---|---|
| 3,022,042 | 2/1962 | Orcutt . | |
| 3,347,521 | 10/1967 | Bingham . | |
| 3,834,668 | 9/1974 | Casey | 254/29 R |
| 3,881,558 | 5/1975 | Dolza . | |
| 3,952,384 | 4/1976 | Goldry et al. . | |
| 4,020,641 | 5/1977 | Takada | 405/184 |
| 4,434,969 | 3/1984 | Von Ruden | 254/29 R |
| 4,455,107 | 6/1984 | Schosek | 405/184 |
| 4,502,665 | 3/1985 | Yoder | 254/29 R |
| 4,765,777 | 8/1988 | Gregory | 405/230 |

*Primary Examiner*—Randolph A. Reese
*Assistant Examiner*—John A. Ricci
*Attorney, Agent, or Firm*—Haugen and Nikolai

[57] ABSTRACT

An under ground pipe installation apparatus includes a pair of spaced apart, longitudinally directed I-beams and a carriage slidable longitudinally along upper horizontal surfaces of the I-beams. A pair of hydraulic cylinders, one mounted with respect to each beam, reciprocate longitudinally extended rods, the free ends of which are secured to the carriage. A pair of opposed jaw assemblies are mounted pivotally relative to the carriage about respective transverse pivot axes, to enable their movement into and out of a closure position about a longitudinally extended pipe section. A pair of longitudinally extended coil springs, each attached at its rearward end to an associated one of the hydraulic cylinders, have free ends positioned to engage jaw actuator pins parallel to and laterally outward of the pivot axes, once the rearward traveling carriage reaches a predetermined location along the beams. Further rearward movement of the carriage compresses the springs which, in turn, act upon the actuator pins to pivot the jaw assemblies into the closure position, thus preloading the jaw assemblies against and around the pipe section, prior to any forward movement of the carriage. Alternatively, hydraulic cylinders can be employed between the jaw assemblies and carriage, for moving the jaw assemblies into and out of closure.

21 Claims, 5 Drawing Sheets

HYDRAULIC APPARATUS FOR INSTALLING PIPING BELOW GROUND

BACKGROUND OF THE INVENTION

This invention relates to devices for driving piping sections through ground, and in particular for installing tubular piping or conduits beneath highways and other hard surfaces.

Generally, the most convenient method for installing piping, cable or the like under ground is to form a trench along a predetermined path, install the piping or cable and refill the trench. This approach can be time consuming and difficult in connection with installations under particularly hard surfaces, for example highways, streets, sidewalks, parking lots and airport runways. In such applications, it is preferable to install pipe or cable without a breaking of the ground above and the subsequent need to repair the surface.

One known approach to meeting this need involves digging a working trench on one side of the hard surface, e.g. a highway. An underground pipe installing device is anchored within the trench, oriented to support and drive a pipe installing rod horizontally into the ground beneath the highway. The rod is advanced or driven through the ground, for example by one or more hydraulic cylinders, until the lead end of the rod emerges on the opposite side of the highway, e.g. into a target trench previously formed on the opposite side.

In certain pipe installing devices, pipe sections themselves are used in lieu of the pipe installing rod. For example, U.S. Pat. No. 3,347,521 (Bingham) is directed to a device which drives a tubular metal conduit. At the lead end of the conduit is a rounded drive head provided with an adapter section to accommodate different conduit diameters. A second adapter is provided for attaching the rearward end of the conduit section to the plunger of a hydraulic ram.

U.S. Pat. No. 3,834,668 (Casey) discloses a pipe pushing apparatus employing two hydraulic cylinders, one on each side of the pipe section being driven. Ground abutting end plates at opposite ends of the device secure it with respect to the ground. Pivotally mounted jaws on opposite sides of the pipe sections are movable to grip the pipe for alternatively and selectively pushing or pulling the pipe, depending on which members of a set of removable pins are installed. Forwardly of the jaws is a guide for orienting and stabilizing the pipe section. U.S. Pat. No. 3,952,384 (Goldry et al) shows a set of three jaws, surrounding a pipe and spaced apart from one another 120 °.

U.S. Pat. No. 4,455,107 (Schosek) concerns a device for installing a solid cylindrical rod in which opposite jaws have semicircular profiles generally conforming to the circular profile of the rod. The opposed jaws are interconnected through motion transmitting devices, said to ensure equal gripping of the opposed jaws so that no flow divider is needed in connection with the hydraulic fluid drive system.

Due to the high forces involved, sometimes up to sixty tons on the jaws or other pipe gripping members, a secure, properly centered gripping action is critical. The proceeding patents are directed to various methods of gripping the piping section or rod for driving. These approaches, while satisfactory in certain respects, fail to address the need to ensure repeated, properly centered gripping of pipe or rod sections by hydraulically reciprocated jaws.

Therefore, it is an object of the present invention to provide a hydraulic pipe driving apparatus with means for biasing pipe gripping jaws into closure prior to initiating a forward stroke of the jaws.

Another object of the invention is to provide a pipe driving apparatus with interchangeable jaw inserts corresponding to pipes of different sizes, as well as interchangeable inserts for pipe guiding structure spaced apart from the jaws.

Another object of the invention is to provide an improved means for centering a driven rod or pipe with respect to opposed jaws or other gripping members.

Yet another object is to provide a means for closing opposed, hydraulically operated jaws or other gripping members upon a pipe or rod, operable independently of the forward driving action of the hydraulic cylinders.

SUMMARY OF THE INVENTION

To achieve these and other objects, there is provided an apparatus for installing pipe under ground. The apparatus includes a frame means having a guide surface and an anchoring means for securing the frame means integrally to the ground. A carriage is supported on the guide surface for reciprocating travel in longitudinal forward and rearward directions relative to the frame means. A pair of opposed gripping members is mounted pivotally to the carriage for movement about respective transverse pivot axes, into and away from a closure position about and frictionally engaged with a longitudinally extended pipe section, whereby the pipe section travels longitudinally with the carriage and jaws. When pivoted away from the closure position, the jaws release the pipe section for longitudinal travel relative to the jaws and carriage. A drive means is mounted to the frame means and to the carriage for reciprocating the carriage between forward and rearward locations along the guide surface. When the drive means and a ground induced counterforce in the pipe section act upon the carriage to maintain the jaws in the closure position about the pipe section, the carriage moves forward, with the pipe section being released when the carriage moves rearward. A biasing means is mounted to the frame means and is positioned to engage the jaws when the carriage, moving rearwardly, reaches a predetermined location proximate the rearward location. The biasing means, responsive to rearward movement of the carriage beyond the predetermined location, pivots the jaws into the closure position about the pipe section.

Preferably the frame means includes first and second elongate, longitudinally extended and laterally spaced apart beams, anchored by lateral plates at opposite forward and rearward ends of the beams, each plate attached to and spanning the distance between the beams. The carriage likewise spans the lateral distance between the beams.

The gripping members include first and second jaw assemblies pivotally mounted respectively to opposed first and second sections of the carriage. The jaw assemblies preferably have semicircular profiles, which together correspond to the circular profile of the driven pipe. The jaw assemblies further can include sets of removably mounted jaw inserts, with each set or pair of inserts corresponding to a different diameter pipe.

The drive means includes first and second hydraulic cylinder and rod assemblies, each including a cylinder mounted to its associated one of the beams, and a longitudinally reciprocating rod attached to the carriage. The hydraulic assemblies are operated in concert to slide the carriage along the guide surface provided by the two beams.

The preferred biasing means includes first and second coil springs, each with its rearward end fixed to an associated one of the hydraulic cylinders. First and second transverse jaw actuator pins are mounted to the first and second jaw assemblies, respectively, at locations offset from the transverse pivot axes of the jaws. The actuator pins further are positioned to engage the forward ends of their associated springs when the carriage is in the predetermined location. Further rearward movement of the carriage thus compresses the springs, with each spring in turn acting upon its associated actuator pin to pivot the associated jaw into the closure position.

In a particularly preferred version of the invention, the actuator pins are parallel to and forwardly of the associated pivot axes. With respect to the driven pipe, the actuator pins are laterally outwardly of the pivot axes. Further, to facilitate a fine adjustment with respect to particular piping, a means is provided for adjusting the lateral separation between the transverse pivot axes, thus to facilitate an optimal positioning of the jaws along the piping section when in the closure position.

In accordance with the present invention, no auxiliary driving rod is required, as the pipe sections themselves perform the function of the driving rod. To facilitate forward movement of the pipe through the ground, a forwardly converging driving head is removably attached to the lead end of the first piping section. Separately sized driving heads can be provided to correspond with pipe sections of different diameters.

With the pipe longitudinally aligned and between the jaws, the carriage is drawn rearwardly, beyond the predetermined location, until the opposed first and second coil springs are sufficiently compressed to apply the desired force in biasing the jaws into their closure positions. Thus, initial closure of the jaws occurs independently of any forward movement of the piping and carriage, and the attendant high level of forces involved in such movement. Rather, closure of the jaws is controlled by the coil springs, providing balanced forces on opposite sides of the piping section and tending to center the piping section during closure. Further, the total closure force upon the jaws can be controlled by the amount of rearward carriage movement beyond the predetermined location, as this determines the amount of spring compression.

Following jaw closure, the carriage is advanced to advance the piping section. The closure force of the coil springs diminishes as the carriage advances, and is null once the carriage advances beyond the predetermined location. Jaw closure is maintained, however, due to the rearward counterforce upon the piping, due to resistance of its advancement through the ground.

Once the carriage has reached the forward location, the carriage is retracted, a movement which immediately pivots the jaws away from the closure position, permitting the jaws and carriage to move rearwardly relative to the piping section beyond the predetermined location, whereupon the springs once again bias the jaws into closure. The gripping and driving action is repeated until the piping is advanced sufficiently to emerge from the ground on the opposite side of the highway or other surface.

Thus, in accordance with the present invention, multiple piping sections can be driven horizontally beneath a generally horizontal surface, in a relatively low cost manner which avoids the need to break up the surface or make any surface repairs following installation.

IN THE DRAWINGS

For a further understanding of the above and other features and advantages, reference is made to the following detailed description of the preferred embodiment and the drawings, in which.

DETAILED DESCRIPTION OF THE PREFERRED EMBODIMENTS

Figure 1:
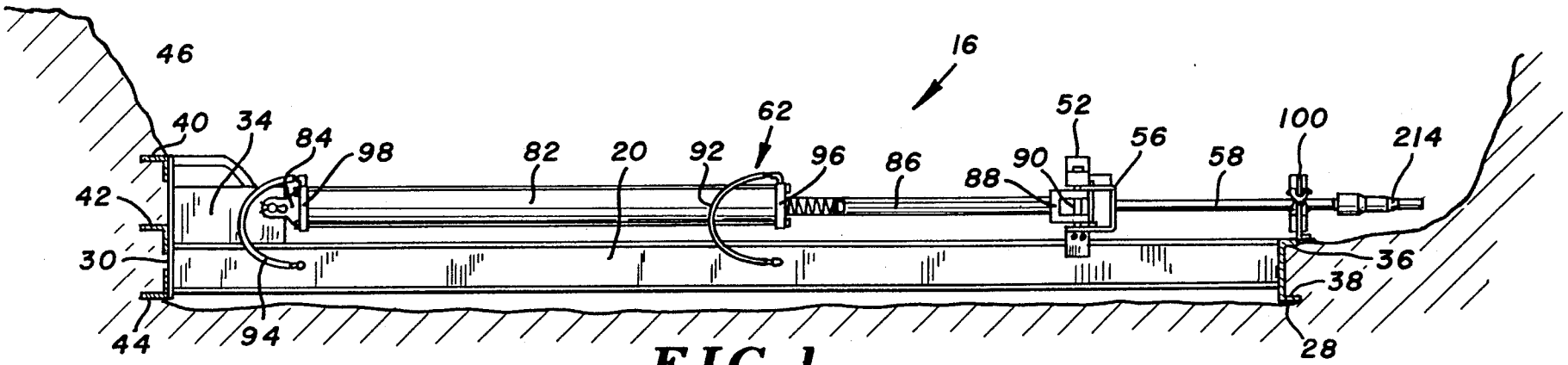
FIG. 1 is a side elevation of a hydraulic pipe driving apparatus constructed in accordance with the present invention.
Figure 2:
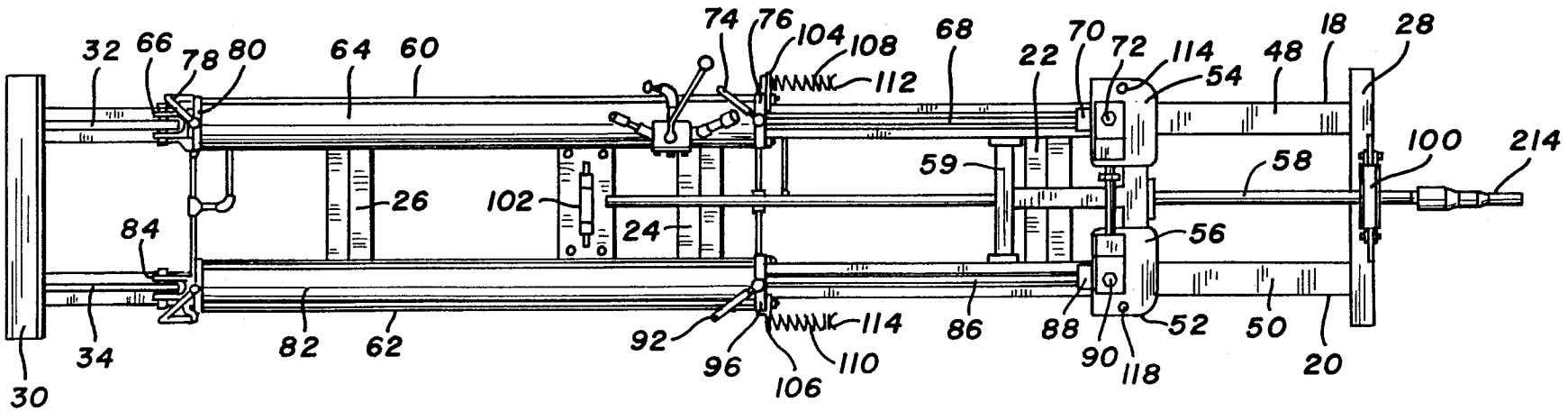
FIG. 2 is a top plan view of the pipe driving apparatus.

Turning now to the drawings, there is shown in FIGS. 1 and 2 a hydraulic pipe driving device 16, including a stationary frame, a carriage carrying pipe gripping jaws and movable relative to the frame, a drive means for reciprocating the carriage longitudinally on the frame, and a biasing structure for preloading the jaws against a pipe section between the jaws, prior to a forward stroke of the carriage.

More particularly, the stationary frame includes two spaced apart and longitudinally extended beams 18 and 20, spaced apart from one another and connected by a plurality of intermediate lateral members 22, 24 and 26. The beams have an I-shaped cross-section (FIG. 3), while the intermediate lateral members can be angled or L-shaped members, welded or otherwise secured to the beams. A laterally directed forward pressure plate 28 spans the distance between beams 18 and 20 and is connected to the forward ends of the beams. A rearward pressure plate 30 likewise extends between the beams, and is mounted to the beams as well as to cylinder mounts 32 and 34 secured on beams 18 and 20, respectively. Upper and lower teeth respectively at 36 and 38 project forwardly of pressure plate 28 with teeth at 40, 42 and 44 projected rearwardly of the rearward pressure plate.

As seen in FIG. 1, device 16 typically is positioned in a trench dug into the ground as indicated at 46. Beams 18 and 20 extend horizontally, with pressure plates 28 and 30 packed against the ground, and their corresponding teeth embedded into the ground, thus to secure the frame.

Beams 18 and 20 have respective upper surfaces 48 and 50 which cooperate to provide a planar, horizontal guide surface supporting a carriage 52. The carriage is reciprocable longitudinally along beams 18 and 20 and includes a pair of opposed pipe gripping jaw assemblies 54 and 56 on opposite sides of a longitudinally extended pipe section 58. A stabilizing assembly 59 slides on beams 18 and 20 and maintains a longitudinal alignment of the jaw assemblies.

A pair of drive assemblies 60 and 62 are provided for reciprocating carriage 52, one such assembly along each beam. Assembly 60 includes a hydraulic cylinder 64 supported on cylinder mount 32 through a bracket 66. A rod 68 is reciprocable within cylinder 64 and is connected to carriage 52 by an integral yoke 70 and a transverse or upright carriage bolt 72 passing through the carriage and yoke. The reciprocation of rod 68 is controlled by selectively supplying the hydraulic fluid to cylinder 64, either through a fluid line 74 in communication with the cylinder through a forward end plate 76, or a fluid line 78 connected through a rearward end plate 80 of the cylinder.

In similar fashion, drive assembly 62 includes a hydraulic cylinder 82 supported on cylinder mount 34 through a bracket 84, with a reciprocating rod 86 terminating in a yoke 88 supported on the carriage by an upright carriage bolt 90. Hydraulic fluid lines 92 and 94, connected respectively to forward and rearward end plates 96 and 98 of the cylinder, are used for selectively providing hydraulic fluid to the cylinder. If desired, auxiliary means can be provided to support cylinders 64 and 82, which remain fixed with respect to beams 18 and 20.

Ahead of carriage 52, pipe section 58 is supported by a forward guide assembly 100, thus to orient the pipe section horizontally, or more particularly parallel to the longitudinally extending beams. The forward guide assembly includes an insert selected in accordance with the diameter of pipe section 58, removably mounted to the remainder of the assembly in a manner later explained. For particularly long pipe sections or series of pipe sections, driving device 16 further includes a follower guide assembly 102 for added support and guidance.

As seen in FIG. 2, a mounting plate 104 extends laterally outwardly of hydraulic cylinder 64, and a similar mounting plate 106 extends laterally outwardly of hydraulic cylinder 82. Mounting plate 104 supports a longitudinally extended coil load spring 108, with plate 106 similarly supporting a coil load spring 110. At the free end of spring 108 is a capture member or cup 112 having a semicircular horizontal profile such that the cup is open in the forward direction, and positioned to engage a transverse jaw actuator pin 114 in the carriage/jaw assembly. A similarly shaped cup 116 is positioned to engage an opposite transverse jaw actuator pin 118. Thus, when carriage 52 is moved rearwardly to a predetermined location, cups 112 and 116 engage jaw actuator pins 114 and 118, respectively. Further rearward movement of the carriage beyond the predetermined location compresses load springs 108 and 110. In turn, the restoring force of the compressed springs urges actuator pins 114 and 116 in arcuate paths, each about the upright pivot axis defined by its associated one of carriage connecting bolts 72 and 90. Consequently, the force of springs 108 and 110 pivots jaw assemblies 54 and 56 into a closure position around and against pipe section 58.

Figure 3:
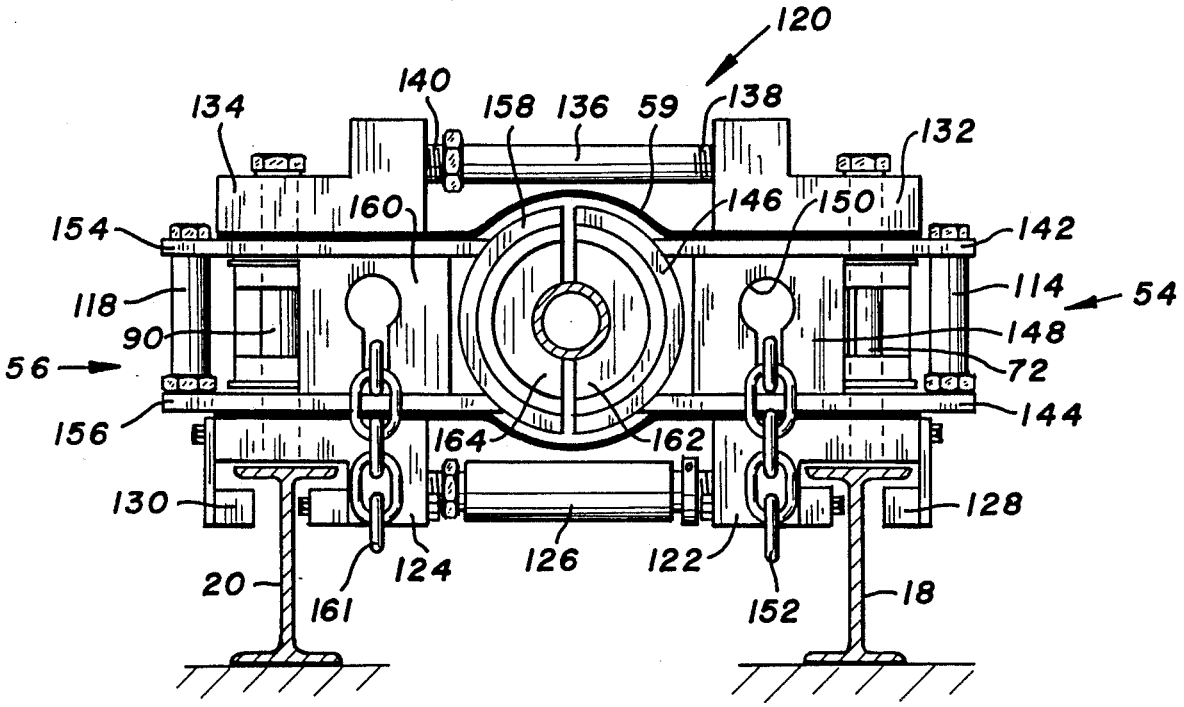
FIG. 3 is a sectional view taken along the line 3—3 in FIG. 2.
Figure 4:
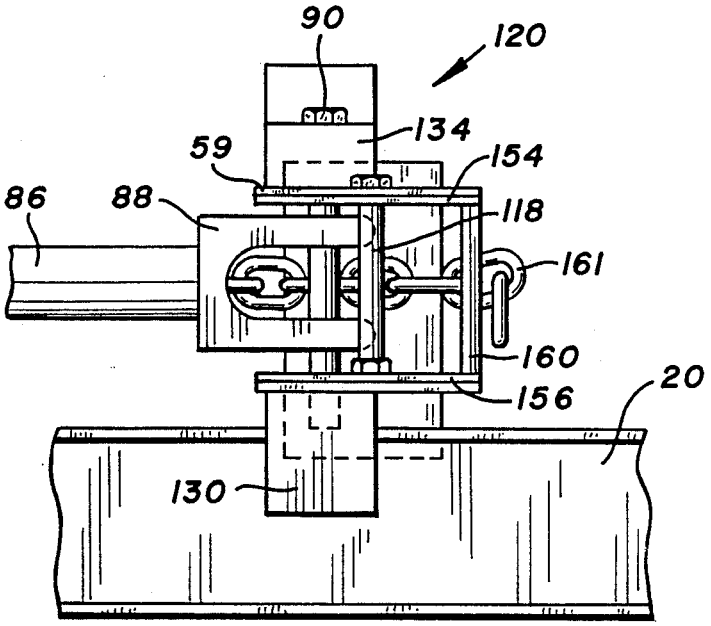
FIG. 4 is an enlarged side view of a portion of FIG. 1.

Carriage 52, as disclosed in FIGS. 3 and 4, includes a reciprocating carriage frame 120 and opposed jaw assemblies 54 and 56, mounted to reciprocate with and pivot relative to the carriage frame. Carriage frame 120 includes a pair of opposed lower blocks 122 and 124, joined by a laterally extended lower coupling bolt 126. Retainers 128 and 130 are fastened to outward surfaces of blocks 122 and 124, respectively, and maintain the blocks on the horizontal upper surfaces of beams 18 and 20. Carriage bolt 72 joins an upper block 132 with respect to lower block 122, while carriage bolt 90 joins an opposed upper block 134 to lower block 124. Upper blocks 132 and 134 are joined to one another through an upper coupling bolt 136.

Coupling bolts 126 and 136 are rotatable to adjust the lateral separation between blocks 122 and 132 on one side of pipe section 58, and blocks 124 and 134 on the other. More particularly, threads 138 of upper coupling bolt 136 are righthanded, while threads 140 at the opposite end of the bolt are left-handed. Lower coupling bolt 126 similarly is provided with oppositely directly threads at its opposite ends. Thus, bolts 126 and 136 are rotated selectively, either to increase or decrease the lateral distance between opposing blocks.

Jaw assembly 54 includes parallel and spaced apart upper and lower plates 142 and 144. The laterally outward ends of plates 142 and 144 are secured with respect to one another by jaw actuator pin 114, which preferably is a ¾ bolt. The laterally inward ends of the plates are welded to a semicylindrical jaw shoe 146. A chain lock plate 148 is secured by welding to the upper and lower plates, and includes a keyway 150 containing a chain 152. Carriage bolt 72 passes through openings in upper and lower plates 142 and 144, and accordingly permits rotation of jaw assembly 54 about the vertical axis through the carriage bolt. Jaw assembly 56 is similar to jaw assembly 54, including upper and lower plates 154 and 156 welded to a jaw shoe 158, and further secured with respect to one another by jaw actuator pin 118 and a chain lock plate 160 containing a chain 161. Chains 152 and 161 are hooked to the trailing end (not shown) of the pipe section being driven, to prevent excessive slippage of the jaw assemblies. A semicircular jaw insert 162 is fastened to jaw shoe 146, and a similar opposed jaw insert 164 is secured to jaw shoe 158.

As seen in FIG. 4, carriage bolt 90 is contained within openings through the upper and lower portions of yoke 88, which is secured to the forward end of rod 86. Yoke 70 at the forward end of rod 68 similarly contains carriage bolt 72. Thus, when cylinders 64 and 82 are operated to reciprocate rods 68 and 86 in concert, carriage frame 120 and the jaw assemblies reciprocate as well, in particular by a sliding action of lower blocks 122 and 124 on the upper surfaces of beams 18 and 20, respectively.

Figure 5:
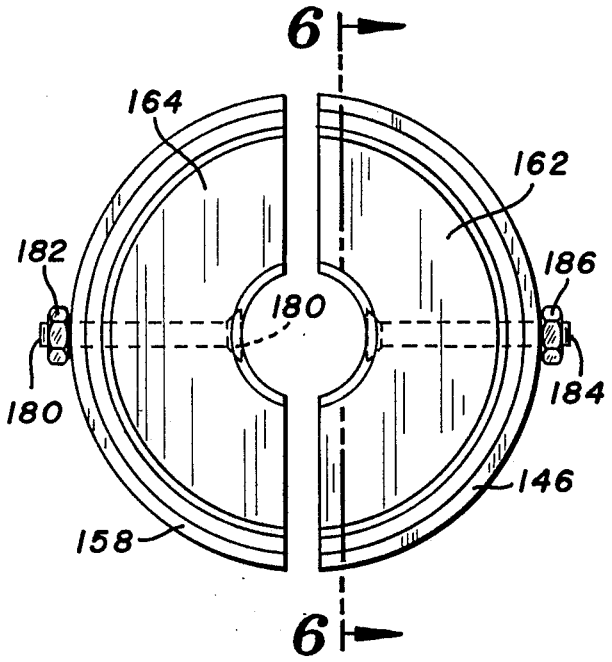
FIG. 5 is an enlarged forward elevation of opposing jaw shoes and jaw inserts of the device.
Figure 6:
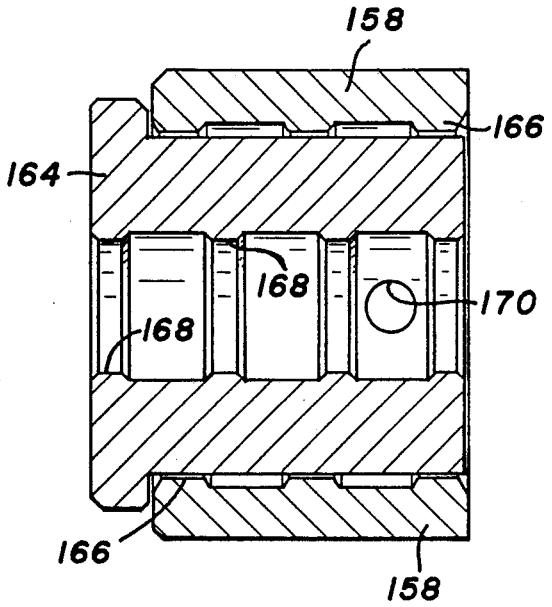
FIG. 6 is a sectional view taken along the line 6—6 in FIG. 5.

When device 16 is used to drive a pipe of a selected maximum diameter, for example four inches, jaw inserts 162 and 164 are removed and jaw shoes 146 and 158 grip the pipe section directly. Otherwise inserts 162 and 164, or another pair of jaw inserts corresponding to the pipe diameter, are secured to the jaw shoes. The alignment and interchangeable coupling of the jaw shoes and jaw inserts is seen in FIGS. 5 and 6. Insert 164 has a smooth outer surface, semicircular in profile and of a size corresponding to the inside diameter of jaw shoe 158. In particular, flat surfaces of radially inward projections 166 of shoe 158 are contiguous with the exterior surface of the insert. Insert 164 includes a plurality of radially inward projections 168 for clamping pipe section 58. A radially directed aperture 170 through insert 164, and an aperture of similar size through jaw shoe 158, can be aligned to accept a bolt 180, whereupon a nut 182 is tightened to secure the insert to the shoe. A similar bolt 184 and nut 186 secure insert 162 to shoe 146. Preferably a plurality of insert pairs are provided, each pair corresponding to a selected pipe section diameter, e.g. in half inch increments between one and three and one-half inches. All of the jaw inserts have the same outer diameter, but have different inside diameters corresponding to particular pipe sections.

Figure 7:
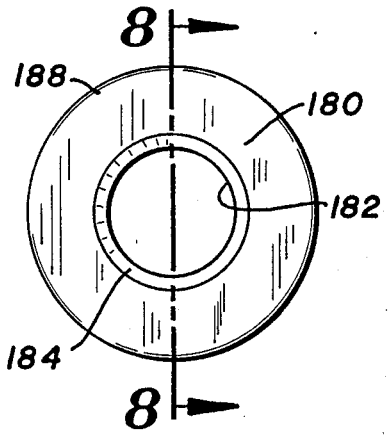
FIG. 7 is a side view of a forward guide insert.
Figure 8:
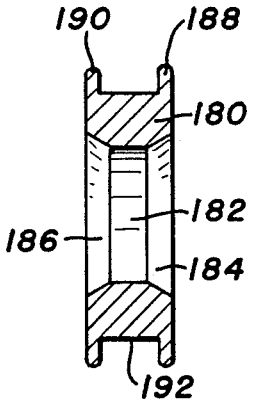
FIG. 8 is a sectional view taken along the line 8—8 in FIG. 7.

Forward guide assembly 100 cooperates with jaw assemblies 54 and 56 to support and align pipe section 58, prior to and during driving of the pipe. Accordingly, a set of interchangeably mounted forward guide inserts, such as that shown at 180 in FIGS. 7 and 8, are provided for use with corresponding pairs of jaw inserts. Insert 180 is annular and includes a pipe supporting surface 182 and inclined surfaces 184 and 186 on opposite sides of the pipe supporting surface. A pair of flanges 188 and !90 project outwardly along opposite sides of an outer surface 192 of the forward guide insert.

Figure 9:
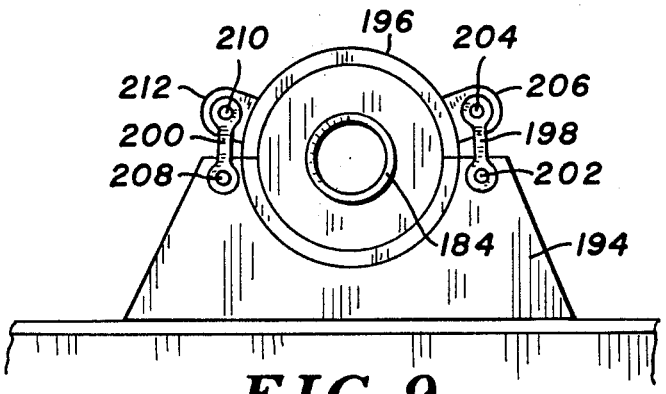
FIG. 9 is a sectional view taken along the line 9—9 in FIG. 2.

As seen in FIG. 9, forward guide assembly 100 includes a lower segment 194 and an upper segment 196 in a wrapping engagement around forward guide insert 180 and contiguous with outer surface 192 thus to confine the insert. The upper and lower segments are fastened together by a pair of hinge links 198 and 200. Hinge link 198 is secured by a pair of steel pins, a pin 202 through aligned openings in the hinge link and lower segment, and pin 204 through aligned openings in link 198 and an ear 206 integral with the upper segment. Steel pins 208 and 210 similarly link lower segment 194 with an ear 212 integral with the upper segment on the opposite side. At least one of the steel pins is removable to permit substitution of an alternative forward guide insert having the same diameter outer surface but with a larger or smaller inner diameter, as desired.

Figure 10:
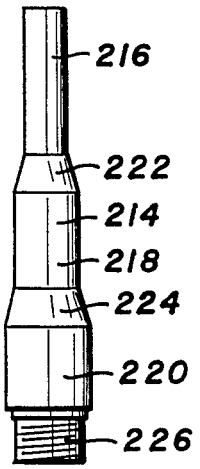
FIG. 10 is an enlarged view of a drive point of the device.

FIG. 10 shows a drive point 214 to include three cylindrical sections 216, 218 and 220 of increasing diameter, with tapered sections 222 and 224 between the cylindrical sections. The drive point is threaded as at 226 for securement to the forward end of pipe section 58. Preferably, drive 16 includes a set of drive points, each corresponding to a selected pipe diameter.

Figure 11:
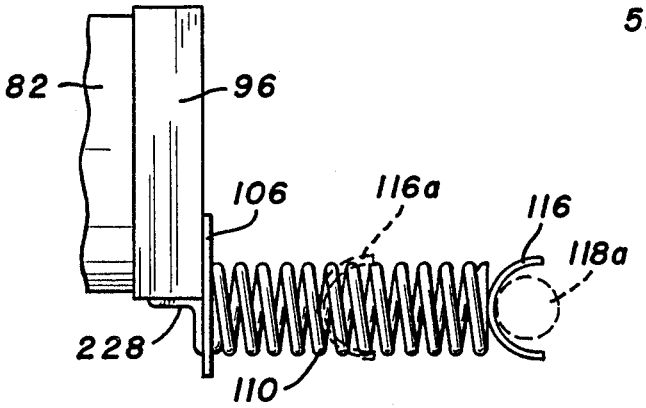
FIG. 11 is an enlarged top plan view of one of the load springs of the device.

As seen in FIG. 11, load spring 110 is mounted to end plate 96 of hydraulic cylinder 82 through an angle brace 228 and plate 106, so that semicylindrical cup 116 is forwardly open and supported at the free end of the load spring. Opposite spring 108 and cup 112 are similarly supported with respect to end plate 76 of hydraulic cylinder 64. Broken lines as at 118*a* indicate the position of jaw actuator pin 118 when carriage 52 is in the predetermined position.

Further rearward movement of the carriage, to its rearwardmost position, compresses load spring 110 to approximately half of its normal, unstressed length, as indicated by the position of cup 116 represented in broken lines 116*a*. Load spring 108 is similarly compressed, and thus the load springs act in concert, applying the same, substantially longitudinal force to actuator pins 114 and 118, thus to urge the jaw assemblies into closure about pipe section 58.

Figure 12:
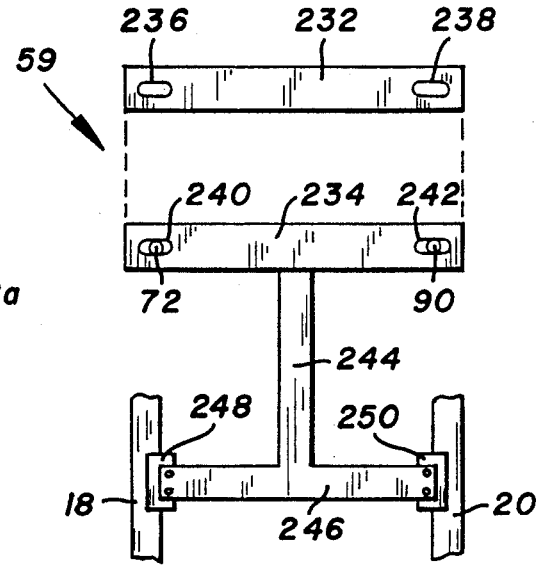
FIG. 12 is a top plan view of a stabilizing assembly used in the device of FIG. 1.

In FIG. 12, stabilizing assembly 59 is shown apart from the device and disassembled to reveal a top section 232 and a bottom section 234, positionable above and below the jaw assemblies respectively as seen in FIG. 3. Elongate slots 236 and 238 through the top section are positionable in alignment with corresponding elongate slots 240 and 242 in the bottom section, with carriage bolts 72 and 90 each contained within an aligned pair of the slots. A longitudinal frame member 244 is connected to bottom section 234, and also to a transverse slide 246. Supports 248 and 250, connected to opposite sides of slide 246, are slidably mounted to beams 18 and 20, which allows assembly 59 to travel with jaw assemblies 54 and 56 as they are moved longitudinally along the beams. Top and bottom sections 232 and 242 surround and stabilize jaw assemblies 54 and 56. More importantly, with carriage bolt 72 contained in slots 236 and 240, and carriage bolt 90 contained within slots 238 and 242, the stabilizing assembly maintains the desired longitudinal alignment of the carriage bolts and jaw assemblies. The longitudinal alignment is a key factor in ensuring a proper gripping of the pipe section being driven by the device.

Figure 13:
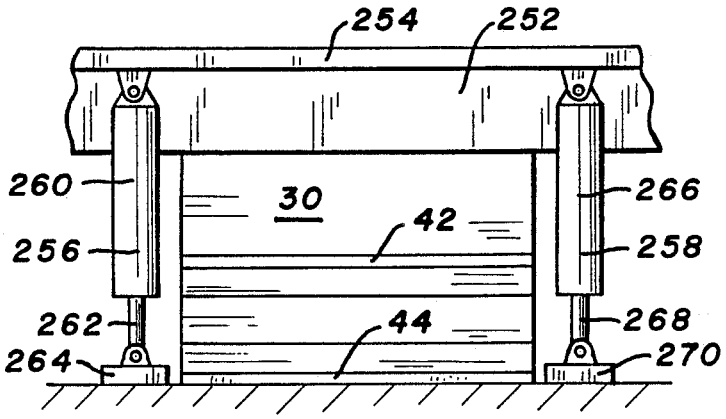
FIG. 13 is a rearward end elevation of a leveling system for the device.

FIG. 13 illustrates a modification particularly useful in leveling device 16 prior to its operation. In particular, an angle plate 252 is secured to rearward pressure plate 30 in lieu of top tooth 40, and extends outwardly of the pressure plate on both sides. Angle plate 252 includes a shelf 254 projected rearwardly of the remainder of the angle plate. A pair of hydraulic cylinder assemblies at 256 and 258 are supported between shelf 254 and the ground at opposite ends of the angle plate. Assembly 256 includes a cylinder 260 and a reciprocable rod 262 mounted on a base plate 264 on the ground. Likewise, assembly 258 includes a cylinder 266, a reciprocating rod 268 and a base plate 270. It is to be appreciated that cylinder assemblies 256 and 258 may be operated either individually or in concert. Together, the assemblies can be employed to raise or lower the rearward end of device 16 with respect to its forward end. Individually, each cylinder can be operated to raise or lower either the left or right side of the device. A leveling indicator (not shown) preferably is built into one of beams 18 and 20, to facilitate a reading by an operator as cylinder assemblies 256 and 258 are used to level the device. Preferably, the ground supporting device 16 is substantially level, so that final leveling is accomplished by moving rods 262 and 268 over distances of at most a few inches.

Figure 14:
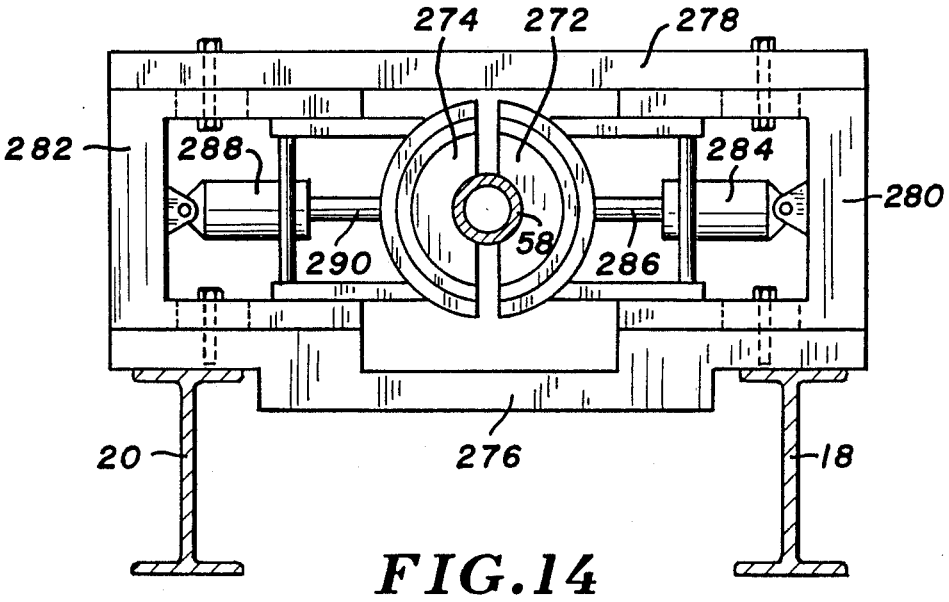
FIG. 14 is a view similar to that in FIG. 3, showing an alternative embodiment pair of jaw assemblies.

FIG. 14 illustrates an alternative embodiment of the present invention, in which opposed jaw assemblies 272 and 274 are slidably supported within a frame including a bottom member 276 slidable on beams 18 and 20, a top member 278, and opposed C-shaped side members 280 and 282. A hydraulic cylinder 284 and reciprocating piston 286 are transversely oriented and operably connected between jaw assembly 272 and side member 280. A similarly oriented hydraulic cylinder 288 and reciprocating rod 290 are operably connected between jaw assembly 274 and side frame member 282.

The gripping action of jaw assemblies 272 and 274 is somewhat similar to the gripping action of corresponding jaw assemblies 54 and 56, with the differences that assemblies 272 and 274 are moved linearly and transversely rather than pivoted, and also are moved transversely independently of their longitudinal movement, which is by hydraulic drive assemblies similar to assemblies 60 and 62.

This alternative embodiment requires two additional hydraulic cylinder and rod pairs, yet affords certain advantages. First, the independent operation of cylinders 284 and 288 permits gripping action regardless of the direction of longitudinal piping section travel. Consequently, jaw assemblies 272 and 274 can be employed to withdraw a pipe section as well as drive it. Further, since no pivotal motion is involved, the desired longitudinal orientation of the jaws and jaw inserts, particularly their inward surfaces which interface with the driven pipe section, is more readily maintained.

Figure 15:
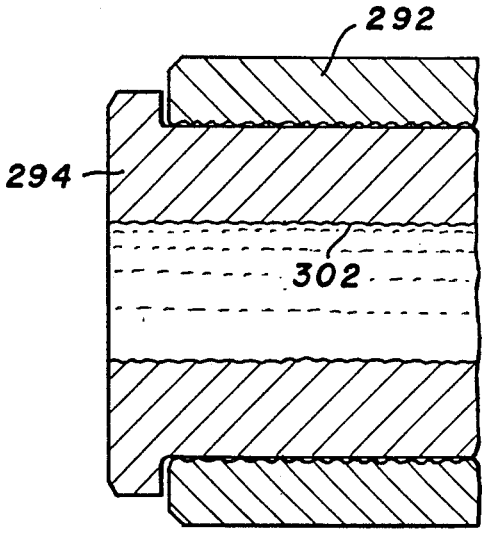
FIG. 15 is a view similar to that in FIG. 6, showing an alternative jaw shoe and jaw insert.
Figure 16:
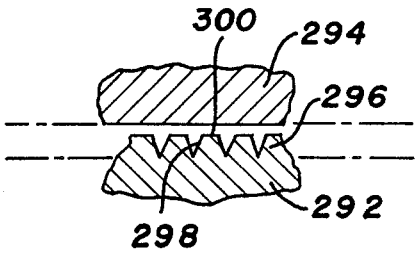
FIG. 16 is an enlarged view of a portion of FIG. 15.

FIGS. 15 and 16 illustrate an alternative jaw shoe 292 and jaw insert 294 which may be employed in lieu of the jaw shoe and insert shown in FIG. 6. Jaw insert 294 has a smooth outer surface, semicircular in profile and of a size corresponding to the inside diameter of jaw shoe 292. In particular, the radially inward surface of jaw 292 includes a series of radially inward projections 296 and V-shaped grooves 298 between the projections. The projections have flat surfaces 300, which are contiguous with the exterior surface of insert 294 when contained against and within jaw shoe 292. The jaw insert, in turn, includes an inside surface 302 with similar projections and grooves, with the flat surfaces of the projections contiguous with the pipe section being gripped. Jaw shoe 292 and jaw insert 294 are fastened to one another with a bolt similar to bolt 180 used in connection with the previously described jaw shoes and inserts, whereby a plurality of inserts are interchangeably mountable, corresponding to pipe sections of different diameters.

The radially inward surfaces of jaw shoe 292 and insert 294 are more easily formed than their counterparts in the previously described shoes and inserts. More particularly, the surfaces are formed by first drilling a cylindrical bore through the insert or jaw shoe, having a diameter less (e.g. by about 0.040 inches) than the diameter of the corresponding pipe section in the case of the insert, and similarly less than the outer diameter of the insert in the case of the jaw shoe. Next, a well known tool for forming screw threads (not shown) is used to form the V-shaped grooves into the bore, leaving flat surfaces 300. A size and spacing between projections 296 corresponding to four such projections per inch has been found particularly satisfactory.

When used to drive piping through ground beneath a highway, for example, drive device 16 first is placed within working trench 46, then firmly secured with respect to the ground by packing against pressure plates 28 and 30 on opposite ends of beams 18 and 20. The desired orientation of the apparatus, typically horizontal, is achieved by preparing the bottom of the trench prior to positioning of the device. With device 16 properly secured, piping section 58 is inserted between jaw assemblies 54 and 56 and through forward guide assembly 100 for the desired orientation. Next, hydraulic cylinders 64 and 82 are operated to retract the carriage and jaw assemblies rearwardly, whereupon these members slide with respect to the pipe section.

As carriage 52 moves rearwardly beyond the predetermined position, load springs 108 and 110 are simultaneously compressed and thus simultaneously pivot jaw assemblies 54 and 56, respectively clockwise about carriage bolt 72 and counterclockwise about carriage bolt 90, thus to move the jaw assemblies, in particular the jaw shoes and inserts, into closure about pipe section 58.

Following closure, carriage 52 is moved forwardly to move the pipe section forwardly as well. Eventually the carriage moves forwardly beyond the predetermined position, at which point load springs 108 and 110 no longer bias the jaw assemblies into closure. By that time, however, drive point 204 has entered the ground, and the ground provides a longitudinally rearward counterforce to the driving force of the hydraulic cylinders acting upon the piping section through the jaw assemblies. This counterforce, in combination with the frictional engagement of the pipe section and jaw assemblies, tends to pivot the jaw assemblies in the same manner as the force of the load springs upon the jaw actuator pins, and thus tends to maintain the jaws in closure. Thus, when carriage 52 has reached the end of its forward stroke, pipe section 58 has been advanced into the ground a distance substantially equal to the forward stroke.

Following the forward stroke, carriage 52 is retracted. With the counterforce in piping section 58 thus removed, jaw assemblies 54 and 56 are free to pivot away from the closure position, removing any tendency in the jaws to pull pipe section 58 rearwardly as the carriage is retracted. Near the end of the rearward stroke, actuator pins 114 and 118 respectively engage cups 112 and 116, whereupon the load springs are compressed to again bias their associated jaw assemblies into closure.

The forward and rearward strokes are repeated until pipe section 58 has been driven a sufficient distance into the ground. Frequently the desired driving distance is greater than a single pipe section. In this event, additional sections are threadedly or otherwise engaged with the lead pipe section, and the sequence of alternative stokes is continued. In any event, each pipe section is used to push any preceding pipe sections and drive point 204 through the ground, eliminating the need for any auxiliary driving rods. Moreover, once the piping sections have been driven a sufficient distance, the job is complete. There is no need for the additional steps of pulling piping through from the opposite side by withdrawing a rod or the like.

A salient feature of the present invention arises from the use of load springs 108 and 110 to load the jaw assemblies into closure, as opposed to relying on the counterforce in the piping section for this purpose. First is the assurance that the respective loads upon jaw assembly 54 and jaw assembly 56 will be substantially equal, as they depend upon the amount of spring compression. Secondly, the loading force is controlled, simply by controlling the amount of compression in the load springs. By contrast, the counterforce along the piping section depends upon the interaction of the pipe section and drive point with the ground, as well as the nature of the soil, and is therefore variable and difficult to predict.

Moreover, the jaw inserts and guide inserts increase the utility of the apparatus as opposed to prior devices, in that the apparatus is conveniently adjusted to suit different diameters. Finally, as closure of the jaws occurs during the carriage retraction rather than on the forward stroke, there is a substantially reduced probability of slippage and possible damage to the pipe sections and jaw assemblies.

What is claimed is:

1. An apparatus for installing pipe under ground including:

a frame means having a guide surface and an anchoring means for securing said frame means integrally to the ground;

a carriage supported on said guide surface for reciprocating travel in longitudinal forward and rearward directions relative to the frame means;

a pair of opposed gripping members mounted pivotally to said carriage for movement about respective transverse pivot axes into and away from a closure position about and frictionally engaged with a longitudinally extended pipe section whereby said pipe travels with said carriage and gripping members, said gripping means when pivoted away from the closure position releasing said pipe section for longitudinal travel relative to the gripping means and the carriage;

a drive means mounted to the frame means and to the carriage for reciprocating said carriage in the forward and rearward directions between forward and rearward locations along the guide surface, said drive means acting upon said carriage to maintain the gripping members in the closure position about the pipe section when moving the carriage forward, and to release the pipe section when moving the carriage rearward;

a stabilizing means mounted to said carriage and slidable with respect to said frame means, for maintaining a longitudinal alignment of said gripping members; and a biasing means mounted to said frame means and positioned to engage said gripping members when said carriage, moving rearwardly, reaches a predetermined location proximate the rearward location, said biasing means, responsive to further rearward movement of the carriage beyond said predetermined location pivoting said gripping members into the closure position about the pipe section.

2. The apparatus of claim 1 wherein:

said frame means comprises first and second elongate, longitudinally extended and spaced apart beams.

3. The apparatus of claim 2 wherein:

said anchoring means comprises first and second transverse plates spanning the distance between said beams and mounted respectively to the forward and rearward ends of the beams.

4. The apparatus of claim 3 wherein:

said carriage includes first and second opposed carriage sections slidably mounted on respective upper horizontal surfaces of said first and second beams.

5. The apparatus of claim 4 wherein:

said gripping members comprise first and second jaw shoes pivotally mounted to said first and second carriage sections by first and second upright carriage bolts, respectively.

6. The apparatus of claim 5 further including:

a pair of jaw inserts, one of said inserts removably secured to each of said jaw shoes.

7. The apparatus of claim 6 wherein:

said jaw inserts have interior surface profiles corresponding to the exterior surface profile of said pipe section, and said jaw inserts substantially surround said pipe section when in said closure position.

8. The apparatus of claim 6 wherein:

said stabilizing means includes transversely extended upper and lower sections respectively above and below said first and second jaw shoes, and means forming slotted openings through opposite ends of said upper and lower sections for respectively containing an upright carriage bolt forming the pivot axis of its associated gripping member.

9. The apparatus of claim 5 wherein:

said drive means comprises first and second hydraulic cylinder and rod assemblies, each assembly including a hydraulic cylinder mounted to an associated one of said beams, and a longitudinally reciprocating rod mounted to an associated one of said carriage sections.

10. The apparatus of claim 9 wherein:

said biasing means includes first and second coil springs, each spring mounted at one end integrally with respect to an associated one of said first and second beams, said biasing means further including first and second transverse jaw actuator bars, each mounted to an associated one of said jaw shoe means and laterally offset from the pivot axis of the associated jaw shoe means, and further positioned to engage its associated one of said coil springs when said carriage is in a predetermined location, further rearward movement of the carriage beyond the predetermined location compressing the coil springs, with the resultant restoring force in each spring acting upon its associated jaw actuator pin to pivot the associated jaw toward said closure position.

11. The apparatus of claim 10 wherein:

each of said actuator pins is disposed parallel to and forwardly of its associated pivot axis and, with respect to said piping section, laterally outward of the associated pivot axis.

12. The apparatus of claim 4 further including:

means for adjusting the lateral separation between said first and second carriage sections.

13. The apparatus of claim 1 further including:

a vertically adjustable means for supporting said frame means at a rearward end thereof.

14. The apparatus of claim 13 wherein:

said support means includes first and second hydraulic cylinder and piston assemblies, vertically disposed and mounted on opposite sides of said frame means at a rearward end thereof.

15. An apparatus for installing pipe under ground including:

a frame means having a guide surface and an anchoring means for securing said frame means integrally to the ground;

a carriage supported on said guide surface for reciprocating travel in longitudinal forward and rearward directions relative to the frame means;

a pair of opposed gripping members mounted slidably to said carriage for lateral movement toward and away from one another between a closure position about and frictionally engaged with a longitudinally extended pipe section whereby the pipe travels with said carriage and gripping members, and a release position for allowing longitudinal travel of said carriage and gripping members relative to said pipe section;

a first drive means mounted to the frame means and to the carriage for reciprocating said carriage in the forward and rearward directions between forward and rearward locations along the guide surface; and a second drive means, including a first actuator means mounted to the carriage and to the first gripping member and a second actuator means mounted to the carriage and to the second gripping member, said first and second actuator means operable in concert to reciprocate said gripping members toward and away from said closure position.

16. The apparatus of claim 15 wherein:

said frame means comprises first and second elongate, longitudinally extended and spaced apart beams.

17. The apparatus of claim 16 wherein:

said anchoring means comprises first and second transverse plates spanning the distance between said beams and mounted respectively to the forward and rearward ends of the beams.

18. The apparatus of claim 17 wherein:

said gripping members comprise first and second jaw shoes pivotally mounted to said first and second carriage sections by first and second upright carriage bolts, respectively.

19. The apparatus of claim 18 further including:

a pair of jaw inserts, one of said inserts removably secured to each of said jaw shoes.

20. The apparatus of claim 18 wherein:

said first drive means comprises first and second hydraulic cylinder and rod assemblies, each assembly including a hydraulic cylinder mounted to an associated one of said beams, and a longitudinally reciprocating rod mounted to an associated one of said carriage sections.

21. The apparatus of claim 15 wherein:

said first and second actuator means respectively comprise first and second transversely oriented and opposed hydraulic cylinder and rod assemblies, each assembly including a hydraulic cylinder mounted to said carriage, and a transversely reciprocating rod mounted to its associated one of said gripping members.

* * * * *